United States Patent [19]

Swartz

[11] 4,373,283

[45] Feb. 15, 1983

[54] ADVERTISING SIMULATED NEON SIGN DISPLAY

[75] Inventor: William M. Swartz, Highland Park, Ill.

[73] Assignee: Embosograph Display Mfg. Co., Chicago, Ill.

[21] Appl. No.: 280,700

[22] Filed: Jul. 6, 1981

[51] Int. Cl.[3] ..... G09F 13/04

[52] U.S. Cl. ..... 40/564; 40/545

[58] Field of Search ..... 40/564, 545, 544, 541, 40/542

[56] References Cited

U.S. PATENT DOCUMENTS

| | | | |
|---|---|---|---|
| 2,299,331 | 10/1942 | Marinone | 40/542 |
| 2,486,859 | 11/1949 | Meijer | 40/543 |
| 3,510,976 | 5/1970 | Pauline | 40/564 |
| 3,978,599 | 9/1976 | Berger | 40/542 |

FOREIGN PATENT DOCUMENTS

| | | | |
|---|---|---|---|
| 938483 | 10/1963 | United Kingdom | 40/564 |

*Primary Examiner*—Gene Mancene
*Assistant Examiner*—Wenceslao J. Contreras
*Attorney, Agent, or Firm*—Morris Spector

[57] ABSTRACT

An illuminated advertisement type display comprising an open front housing that is closed by a transparent panel of plastic or the like which has a display printed thereon simulating a neon sign. Within the housing, there is a fluorescent light bulb that provides illumination for the printed display. The printing is by "transparent" pigment that may have incorporated therein translucent substances in small amounts, but sufficient to occlude the vision of the fluorescent light bulb to a viewer of the display. Surrounding the printed display is a coating of opaque material, so that the areas surrounding the printed matter is black. This coating may be a high reflecting aluminum foil which also reflects light produced by the fluorescent light to increase the light transmited through the panel.

8 Claims, 5 Drawing Figures

ADVERTISING SIMULATED NEON SIGN DISPLAY

BACKGROUND OF THE INVENTION

This invention relates to display signs of the type simulating neon signs.

Neon display signs, although they have much to commend them, have many known drawbacks among which are their high costs, both initially and for maintenance, their fragility, their negligible visibility when the electric power is off, etc. If they are located where they are exposed to broad daylight, they have a minimum effectiveness, even if the power is on. In an effort to overcome or minimize these drawbacks, display signs have come into use which, although containing no neon tube, are intended to simulate the neon tube signs. These alleviate some of the objections, but diminish some of the virtues of a true neon display. This invention is directed to an imitation type neon display which overcomes or reduces many of the disadvantages of the true neon type display, while minimizing interference with the effectiveness of a true neon type display. It is known in the prior art to use a fluorescent light bulb to transmit light through a display panel that is embossed and painted or printed to simulate a neon tube light. There the embossing introduces objectionable distortion in the light intensity when the sign is viewed at night by the light of the fluorescent tube within the display. Another objection of the prior imitation "neon tube" type displays is that often the fluorescent source of light within the display is visible through the front of the display. The use of a translucent (as distinguished from transparent) panel for the neon-simulating areas of the display causes an undesirable diminution of the light transmitted through those areas. To overcome this by using a fluorescent tube of larger output also increases the cost and, in many instances, causes an increase in heat generation to an undesirable extent.

SUMMARY OF THE INVENTION

This invention, in its best embodiment, provides a simulated neon sign display that is illuminated by fluorescent lamp light transmitted through a flat front panel that is transparent (as distinguished from translucent) to visible light (but opaque to ultra-violet light) at those areas where the neon tube simulation is printed. The printing is by "transparent" pigment. The color along the edges of the tube printing may, be somewhat diminishing intensity of hue towards the center where the color may drop to zero at a pinstripe width that follows the longitudinal center line of the printed simulating tube through which a higher intensity of white light is emitted. To avoid visibility of the fluorescent tube, which would be a "give away" that the "neon tube effect" is simulated, small amounts of dispersed opaque substances may be included in the otherwise "transparent" printing pigment.

The above and other features of this invention are disclosed in the preferred embodiment of this invention described herein.

BRIEF DESCRIPTION OF THE DRAWINGS

Reference may now be had more particularly to the drawings wherein.

DESCRIPTION OF THE PREFERRED EMBODIMENT

Figure 1:
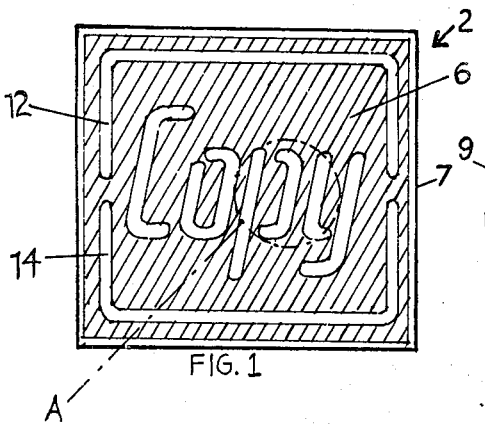
FIG. 1 is a front view of an illuminated display device in which this invention is incorporated, clearness.
Figure 2:
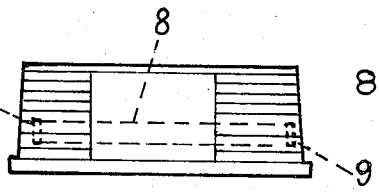
FIG. 2 is a top view of FIG. 1.
Figure 3:
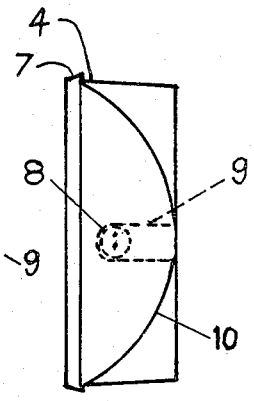
FIG. 3 is a side view thereof.
Figure 4:
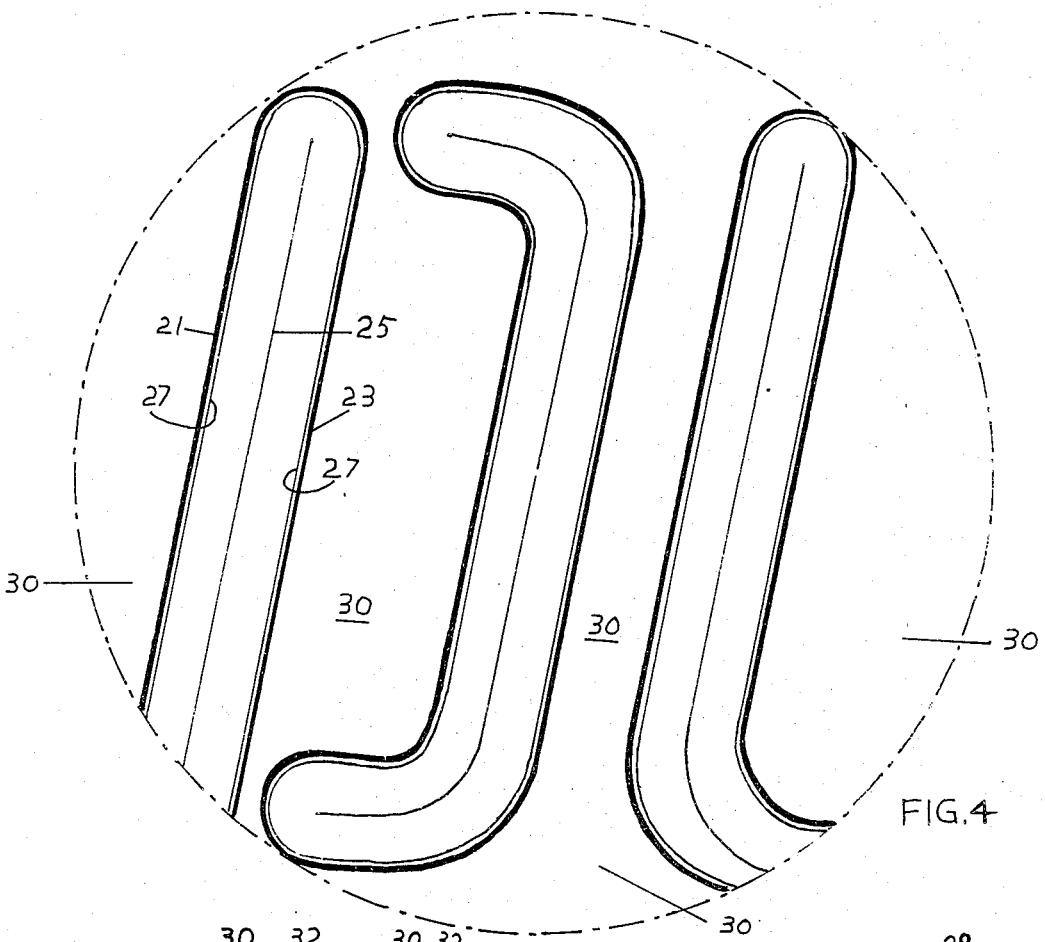
FIG. 4 is an enlargement of the part of FIG. 1 that is within the circle indicated at "A".

A display device 2 comprises an open front housing 4 closed by a removable panel 6 held by a rim 7. Within the housing, is mounted a white light fluorescent light tube 8 in conventional sockets 9 that are electrically connected to a ballast (not shown) within the housing, which in turn is connectable to a source of electricity. A reflector 10, which is preferably of high efficiency is located rearwardly of the light 8 to increase the density of the lamp light reaching the rear of the panel 6. To increase the effectiveness of the reflection, the reflector is preferrably a specular reflector, very shiny, and suitably curved, although it is within the scope of this invention to use a non-specular reflector or one which may not be curved. The reflecting surface extends within the housing from side to side, and from top to bottom of the inside of the housing 4. It is a bright shiny aluminum surface. Where a parabolic reflector is used, as in this preferred embodiment, the center line of the fluorescent light tube 8 is at the focus of the parabola, and with the axis of the light tube parallel to the plane of the panel 6.

The panel is a smooth flat sheet of clear plastic material which is transparent to visible light, (where transparency is hereafter referred to it has reference to visible light). The panel 6 is opaque to ultra-violet light. On the back of the panel a desired message or picture is printed by known printing processes to simulate a "neon type" tube or tubes shaped to convey that message or picture. Tubes of the same or different colors may be simulated such as red, blue, white, etc. The printed simulation is of tubes of a size of the order of one centimeter diameter. The panel itself before the printing has been applied is clear and colorless.

The printed matter is all on the back of the panel 6 so that the front may be easily cleaned, and the panel itself being opaque to ultra-violet light, protects the printed matter from deterioration by ultra-violet rays of ambient light. The printing involves a simulation of the shape of the neon tubes and also the coloring of such tubes when the sign is lit or unlit. The message in this instance is indicated by the word "Copy" printed in red to simulate a neon tube bent to form those letters, and the additional tube simulations 12 and 14 which may be of the same or different colors. The lines 21-23 indicate the tube wall portions along opposite edges of the simulated tube. Along the longitudinal center line, the red is of the least intensity, it may actually be zero red along a pinstripe line 25 extending along the longitudinal center line of the tube. There the light would be maximum and of a white color. Because the white line is very thin, the viewer will not see an outline of the fluorescent tube 8 through that colorless clear line. If desired, that line may be made of greater width in which event small amounts white opaquing substances are introduced to produce a slight milkiness to obscure seeing the subjacent light 8. The red printing hides the view of the tube 8. Where it is not sufficiently intense, a slight amount of translucency may be imparted thereto by adding slight amounts of white pigment. There are preferred types of pigments that combine the capacity to transmit the right kind of light and at the same time cause the transmitted light to be sufficiently diffused or diffracted so that a viewer looking at the simulated neon printing will not get a specular image of the tube 8 that is in fact producing the light that appears to have been produced by the simulated neon tubing. Those pigments include:

207—AZO Yellow
227—Diazo Yellow
304—Copper Phthalocyanine Green
455—Phthaocyanine Red Shade Blue
456—Copper Phthalocyanine Green Shade Blue
498—Carbozol Violet
503—Monoazo Red
538—Anthraquinonoid Red
568—Mondazo Red Perylene Red and TI 02
576—Perylene Red
578—Perylene Red and TI 02
586—Quinacridone Reds There has thus here been combined the ability to disperse the light by solid so called imperfections in the pigments and at the same time retain practically all of the light transmissibility of the clear colorless plastic sheet. This gives a high degree of visibility of the printed matter while avoiding a specular image of the light source.

If desired, a very thin clear colorless line 27, of the thickness of a fine pin, is left on the perimeter of the inside of the simulated neon tubing. Here the very bright white light of the source 8 appears, helping to create the illusion of a glass wall of the "imagined" neon tubing. Because of the thinness this line, (as well as the line 25) does not reveal, to the mind of the observer, the existence of the separate light source 8.

Figure 5:
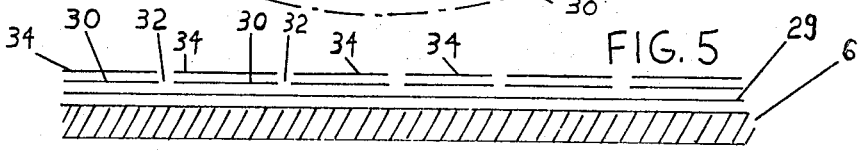

The area of the portion of the panel 6 surrounding the message area is printed in black by printing 30, represented by crosshatching in FIG. 1. In FIG. 5, the message printing is indicated diagrammatically by the line 29. This is then overlaid by an opaque printing represented by the broken line 30-30, preferrably black that is interrupted as indicated as 32 to expose the areas where the transparent message was printed, so that the message appears to have been printed on an opaque sheet that is preferrably black. The black is then covered with a reflecting covering 34 which has the same spaces 32 corresponding to and aligned with the spaces 32 where the message was printed. The reflecting covering 34 preferrably comprises opaque shiny metal foil which reflects the incident light from the source 8 back to the reflector 10 where it is then reflected to the back of the panel 6.

The balancing of a covering of reflection material with "transparent" pigments wherein the resulting translucency is just enough to occlude seeing the tube 8 and no further, may be of greater importance. Another factor to the same effect, which may be sufficient to accomplish the desired result is the fact that the parabolic reflector reflects light coming to it from two sources. One, the main source of light is that coming from the back side of the light source 8. That reflection produces substantially parallel rays of light. The other source of the incident light for the parabolic reflector is the reflection from the shiny reflector 34 on the back of panel 6. This reflected light to the parabolic reflector is from a source not at the focus of the parabola and will therefore be reflected from the parabola at various angles and will tend to occlude a specular viewing of the source 8 through the panel.

The term "neon light" is herein used in the conventional manner to cover small diameter tubing that is bent to the desired shade, evacuated and filled to a low pressure with a gas that produces a desired color of light emission in response to an electric discharge therethrough. Neon gas produces a characteristic red light. Other gasses produce light of different characteristic colors.

What is considered new and sought to be secured by Letters Patent is:

I claim:

1. A simulated neon tube sign comprising a panel having a message portion which is clear and colorless and is transparent to visible light surrounded by a portion that is opaque to visible light, a printing on the message portion of a shape simulating a neon tube and of a color of such tube when it is electrically actuated, said transparent area being a flat surface, said panel having a front side from which it is to be viewed and a reverse side on which the message is formed, said printing comprising a substantially transparent pigment and said opaque portion including an opaque reflecting medium on the back of the panel that reflects light impinging thereon from the rear of the panel in a direction rearwardly of the panel, a reflector located rearwardly of the panel, a light source comprising a fluorescent tube of a diameter substantially greater than the diameter of the simulated neon tube, said light source being between the reflector and the panel for illuminating the rear side of the panel, said reflector receiving light from the rear of the light source and also light reflected rearwardly of the panel by the afforesaid opaque reflecting medium on the reverse side of the panel and said reflector reflecting the incident light back towards said panel to increase the light passing through the transparent dye forming the simulated neon tube.

2. Apparatus according to claim 1 wherein there is provided an open face housing with the afforesaid panel comprising a closure for the open face with the front side faces outwardly of the housing.

3. Apparatus according to claim 2 wherein the afforesaid printing contains light dispersing material in amounts only sufficient to cause dispersion of the visible light transmitted through the pigment, to preclude the transmission of a specular image of the light source.

4. Apparatus according to claim 3 wherein the reflector extends across the housing from one side thereof to the other.

5. Apparatus according to claim 2 wherein the panel is of plastic material substantially impervious to ultraviolet light.

6. An advertising display device comprising a housing having a light source therein and having a front opening, a panel registering with said opening, said panel comprising a transparent sheet which has a printed message on a surface thereof, which printing is in a form simulating a bent tube of the neon type shaped to convey that message, an opaque coating on the sheet around the contour of the printed message, but excluding an area which is a counterpart of and in registration with the outline of the printed message, the printed message comprising a transparent coloring material of a color to create the illusion of the desired neon color effect, there being light dispersing means imparting a cloudy translucency to the printed message area to preclude a specular view of the light source through the message area when the panel is viewed by light from said source, the opaque coated surface appearing black when the panel is viewed solely by light from said light source and black when it is viewed solely by light external of the device, the printing of the message including lines suggestive of the thickness of the wall of the simulated tube and a simulation of the center line of an electrically energized neon tube so that when the panel is illuminated only by ambient light external of the display device the printed message simulates the glow of an energized neon tube.

7. Apparatus according to claim 6 wherein the aforesaid light dispensing material comprises slight amounts of light dispersing pigment incorporated in the aforesaid transparent coloring material to impart thereto the desired slight amount of translucency.

8. Apparatus according to claim 7 wherein said center line includes opaquing substances to produce a slight cloudiness to light reflected therefrom or transmitted there through.

* * * * *